US009723868B2

(12) United States Patent
Griesmayr

(10) Patent No.: US 9,723,868 B2
(45) Date of Patent: Aug. 8, 2017

(54) METHOD FOR PRODUCING A MOUTHPIECE COVER OF A CIGARETTE

(75) Inventor: Guenter Griesmayr, Wels (AT)

(73) Assignee: Tannpapier GmbH, Traun (AT)

( * ) Notice: Subject to any disclaimer, the term of this patent is extended or adjusted under 35 U.S.C. 154(b) by 1248 days.

(21) Appl. No.: 13/498,931

(22) PCT Filed: Sep. 29, 2010

(86) PCT No.: PCT/AT2010/000355

§ 371 (c)(1),
(2), (4) Date: Jun. 6, 2012

(87) PCT Pub. No.: WO2011/038430

PCT Pub. Date: Apr. 7, 2011

(65) Prior Publication Data

US 2012/0240948 A1 Sep. 27, 2012

(30) Foreign Application Priority Data

Sep. 30, 2009 (AT) ..... A 1545/2009

(51) Int. Cl.
*A24D 1/02* (2006.01)
*A24D 3/04* (2006.01)

(52) U.S. Cl.
CPC ..... *A24D 3/04* (2013.01); *A24D 1/02* (2013.01); *A24D 3/041* (2013.01); *A24D 3/048* (2013.01)

(58) Field of Classification Search
None
See application file for complete search history.

(56) References Cited

U.S. PATENT DOCUMENTS

| | | | | |
|---|---|---|---|---|
| 3,039,908 | A | 6/1962 | Parmele | |
| 3,370,592 | A * | 2/1968 | Schultz | A24D 3/04 131/334 |
| 4,094,324 | A | 6/1978 | Bolsinger et al. | |
| 4,582,071 | A | 4/1986 | Westcott et al. | |
| 4,646,763 | A | 3/1987 | Nichols | |
| 4,687,009 | A | 8/1987 | Nichols | |
| 5,150,725 | A | 9/1992 | Cunningham et al. | |
| 2002/0153017 | A1* | 10/2002 | Georgitsis | A24D 3/04 131/331 |
| 2006/0150991 | A1* | 7/2006 | Lee | A24D 1/02 131/331 |
| 2008/0302376 | A1 | 12/2008 | Karles et al. | |
| 2011/0180088 | A1 | 7/2011 | Hooper et al. | |

FOREIGN PATENT DOCUMENTS

| | | |
|---|---|---|
| CH | 394 912 | 6/1965 |
| CL | 48-1997 | 1/1996 |
| CL | 374-2007 | 2/2007 |
| CL | 07-2008 | 1/2008 |
| CL | 2007-2008 | 1/2009 |

(Continued)

OTHER PUBLICATIONS

International Search Report of PCT/AT2010/000355, Feb. 21, 2011.

*Primary Examiner* — Michael J Felton
(74) *Attorney, Agent, or Firm* — Collard & Roe, P.C.

(57) ABSTRACT

A method and a device for producing a mouthpiece cover (2) and/or a filter wrap of a cigarette, a mouthpiece cover material and/or a filter wrap material being provided with at least one inspection hole (4) of a definable shape.

14 Claims, 6 Drawing Sheets

(56) References Cited

FOREIGN PATENT DOCUMENTS

Figure 1:
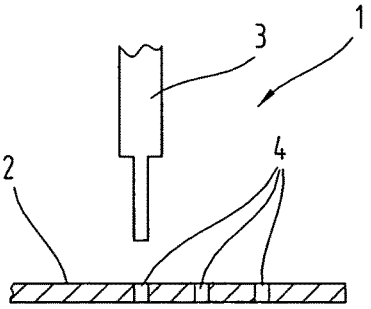

| | | | |
|---|---|---|---|
| DE | 691 06 544 | | 5/1995 |
| EP | 1 252 832 | | 10/2002 |
| EP | 2 033 531 | | 3/2009 |
| FR | 2 273 443 | | 12/1975 |
| GB | 706624 | | 3/1954 |
| GB | 2 260 477 | | 4/1993 |
| LU | 52 346 | | 1/1967 |
| RU | 63 180 | U1 | 5/2007 |
| SU | 1623555 | A3 | 1/1991 |
| WO | WO 79/00269 | | 5/1979 |
| WO | WO 2009/106374 | | 9/2009 |
| WO | WO 2009/109433 | | 9/2009 |

* cited by examiner

METHOD FOR PRODUCING A MOUTHPIECE COVER OF A CIGARETTE

CROSS REFERENCE TO RELATED APPLICATIONS

This application is the National Stage of PCT/AT2010/000355 filed on Sep. 29, 2010, which claims priority under 35 U.S.C. §119 of Austrian Application No. A 1545/2009 filed on Sep. 30, 2009, the disclosure of which is incorporated by reference. The international application under PCT article 21(2) was not published in English.

The invention relates to a method for producing a cigarette mouthpiece.

The subject matter of the invention is also a cigarette mouthpiece.

The terms "mouthpiece cover" and "filter wrap" are defined in this document to mean a "mouthpiece cover paper" or a "filter wrap paper", however the use of the terms "mouthpiece cover" and "filter wrap" is intended to express that the materials used do not always need to be paper, thus the "mouthpiece cover paper" or the "filter wrapping paper" could be made for example from a plastic foil or cellophane etc.

From U.S. Pat. No. 4,094,324 A a method is known for producing a mouthpiece cover of a cigarette, in which a mouthpiece cover paper is provided with randomly arranged microholes to ensure the aeration of the mouthpiece and thereby contribute to a reduction of harmful substances.

During the production of cigarettes it can also be necessary to cut the mouthpiece cover paper precisely, particularly if a logo is applied to the mouthpiece cover paper.

Document EP 1 252 832 A2 relates to a method for producing a cigarette mouthpiece, wherein a transparent filter wrap material is used. The filter wrap material is surrounded by a cover paper which comprises a window, which enables a view of the underlying filter wrap. A paper sleeve made of the cover paper can be provided with an incorporated or adhered transparent foil as a window.

Document CH 394 912 A relates to a cigarette mouthpiece which comprises a cover material with an inspection window which enables a view of an underlying layer.

The subject matter of document US 2006/0150991 is a cigarette mouthpiece in which a partly transparent cover material is used in order to enable a view of an underlying filter. The disadvantage of the solutions known from the prior art is mainly that they are associated with the risk of producing an increased number of rejects.

It is therefore an objective of the invention to overcome the disadvantages of the prior art.

This objective is achieved by a method according to the invention.

An inspection hole is defined in this case as a hole with a size which enables a layer underneath the hole to be seen with the naked eye.

With a suitable hole size on the one hand a very good aeration of the mouthpiece is achieved and on the other hand also it is possible to detect the holes easily. In this way the exact alignment of the window to a logo applied to the mouthpiece is possible and thus it is possible to achieve a uniform positioning of the logos for all mouthpieces. Furthermore, the solution according to the invention also provides the option of having different optical designs for the mouthpiece. Thus for example part of a logo could be arranged on a layer arranged underneath the mouthpiece cover which can be seen through an inspection hole, whereas the other part of the logo could be attached to the mouthpiece cover. The visibility of the holes also makes it easier to check as to whether the position of the inspection holes corresponds to the desired position and is the same in all of the mouthpieces produced, so that compared to conventional perforations also a uniform quality of the produced mouthpieces themselves is guaranteed with very large production output. A mouthpiece cover according to the invention for a cigarette thus comprises at least one inspection hole.

In an advantageous variant of the invention, which is characterized by low material costs, the mouthpiece cover material and/or the filter wrap material is paper or cellophane.

It is possible to achieve particularly good detectability of the inspection holes and coordination of the aeration of the mouthpiece in that the mouthpiece cover material and/or the filter wrap material is provided with a predeterminable pattern comprising several inspection holes.

In one variant of the invention, which in addition to production technical advantages also enables the good detection of the inspection holes and an exact arrangement of additional surface features, such as for example logos, a plurality of inspection holes are arranged in at least one row.

In particular, with the use of mechanical stamping or cutting tools it can be an advantage in terms of production technology, if the at least one row is a linear row. In this way movements of the stamping tool relative to the paper surface can be reduced to a minimum so that a relatively simple tool design is possible. The aeration of the mouthpiece can be improved further in this way in that the mouthpiece cover material and/or the filter wrap material are provided with at least two parallel tows of inspection holes. In this case it has also proved to be particularly advantageous if at least one window is formed by a plurality of spatially adjacent inspection holes. In this case it is also advantageous if at least two inspection holes of different size are formed.

Advantageously, the inspection holes are produced by stamping and/or cutting the mouthpiece cover material and/or the filter wrap material in sections. These methods have proved to be particularly advantageous mainly with regard to the material load and the achieved quality of the inspection holes.

In one embodiment of the invention, the particular advantages of which are that in a very simple manner there is a very large amount of freedom with regard to the positioning of the inspection holes, a laser is used to produce the inspection holes.

The production of inspection holes of very high quality can be achieved in that a mechanical stamping device is used to produce the inspection holes. By using a mechanical stamping device for example very sharp-edged borders and an exact hole size can be achieved.

In an advantageous variant of the invention, which prevents glue escaping during the application of the mouthpiece cover or the filter wrap material onto a filter strand, it is ensured that below the mouthpiece cover material and/or filter wrap material provided with at least one inspection hole a continuous layer of transparent or semi-transparent material, for example plastic, paper or cellophane is applied which covers the inspection hole. The term "transparent" is defined here to mean that the used material is a transparent material in the visible electromagnetic spectral range. Transparent is defined in terms of this document as a material which makes visible a layer arranged behind the material from the direction of vision of the observer. The term semi-transparent is a graduation of transparency. In a semi-transparent material the visibility of the layer arranged under the material is reduced compared to a transparent material. This can be achieved for example by coloration of the transparent material.

In a particularly advantageous embodiment of the invention a cellophane layer is applied as a layer for covering the inspection hole. The cellophane layer can be designed to be transparent or non-transparent. In the case of a transparent cellophane layer the latter allows a view of the layer or layers arranged underneath.

According to a preferred embodiment variant of the invention the layer covering the inspection hole can be adhered, stamped etc. onto the mouthpiece cover material and/or filter wrap material provided with at least one inspection hole. This can be performed, as also mentioned below, by means of hot or cold adhesion, hot foil stamping, etc.

According to a further variant of the invention it is possible that for the production of the inspection holes on at least two strips of a mouthpiece cover or filter wrapping paper, the facing edges of which are spaced apart from one another, a layer of transparent or semi-transparent material is applied. The mouthpiece cover material or filter wrap material according to the invention can be formed in this case of at least two paper strips and at least one plastic strip, in particular a cellophane strip. The plastic strip is arranged in this case between the two paper strips and is connected with the latter. In the aforementioned manner, an inspection hole can be produced simply without the stamping out or cutting out the inspection holes being necessary.

To improve the properties of the mouthpiece, in particular with regard to the aeration properties, at least one intermediate layer can be arranged between the mouthpiece cover material and the filter wrap material.

According to an advantageous embodiment of the invention, by means of which the advantages of the invention can be improved further, the at least one intermediate layer can also have at least one inspection hole, wherein the at least one inspection hole of the at least one intermediate layer can be smaller than the at least one inspection hole of the mouthpiece cover. In this way also a particular optical design of the mouthpiece can be created. An additional advantage of this variant of the invention is that the mouthpiece cover and the filter wrap can be aligned and arranged precisely relative one another, as the relative position of these two components can be detected optically.

The underlying objective of the invention can also be achieved by means of a cigarette mouthpiece of the aforementioned type, in that the cigarette mouthpiece is designed to be transparent at least in sections and a view is provided through the mouthpiece cover and/or the filter wrap to an underlying layer.

The mouthpiece cover can be made of paper and comprise a pattern of several inspection holes. A plurality of inspection holes can also be arranged in at least one row, wherein in principle the row can be shaped as desired. Thus a connecting line through the row could be for example a straight line, a sinusoidal line or any shape of curve.

It is particularly advantageous with regard to an application of adhesive during the production process of a cigarette if the mouthpiece cover is coated with a layer of transparent and/or semi-transparent material covering the at least one inspection hole, as in this way the passage of adhesive through the inspection hole can be prevented.

Figure 9:
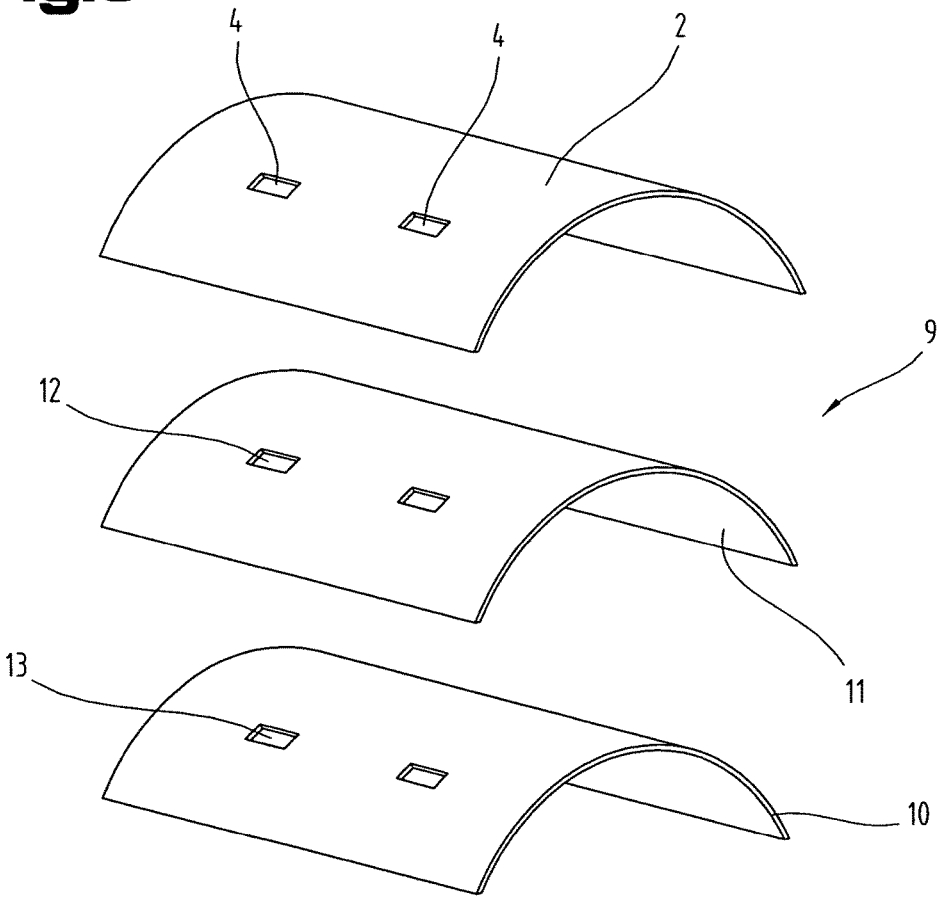
Figure 2:
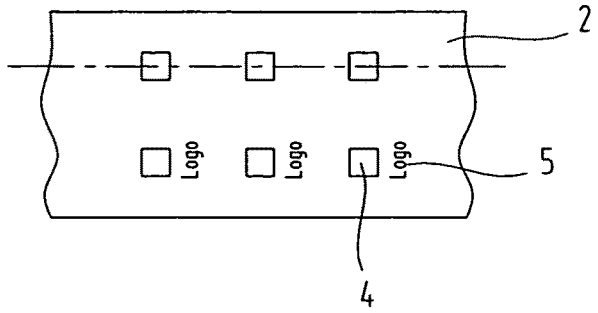
Figure 3:
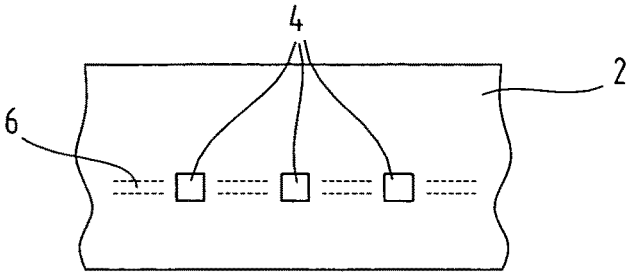
Figure 4:
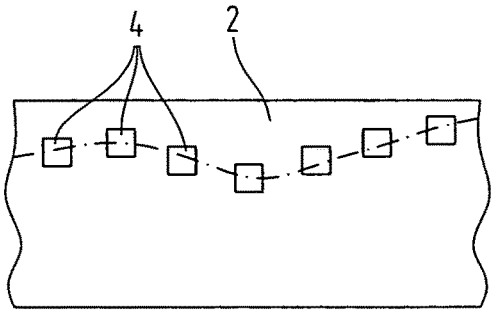
Figure 5:
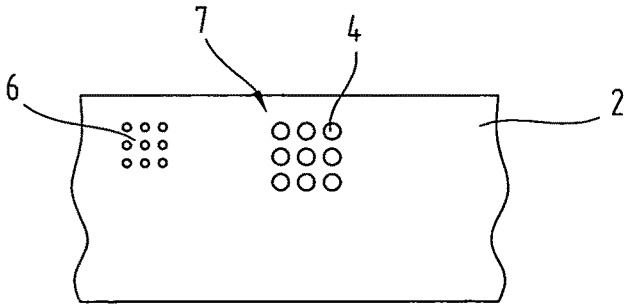
Figure 6:
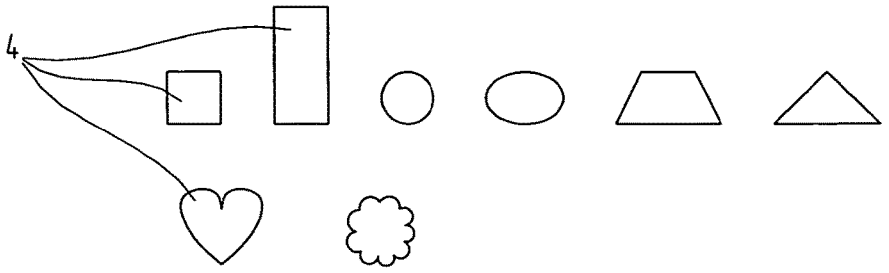
Figure 7:
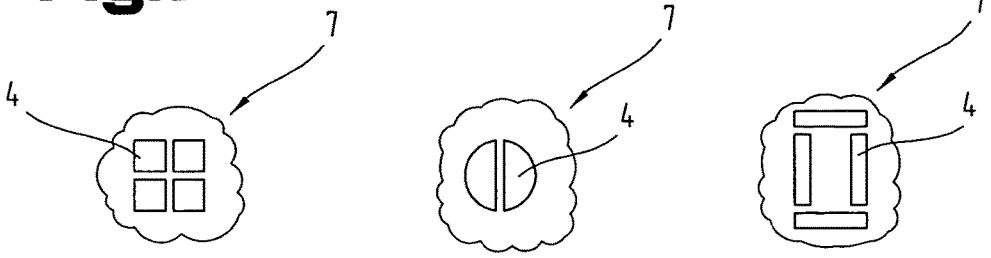
Figure 8:
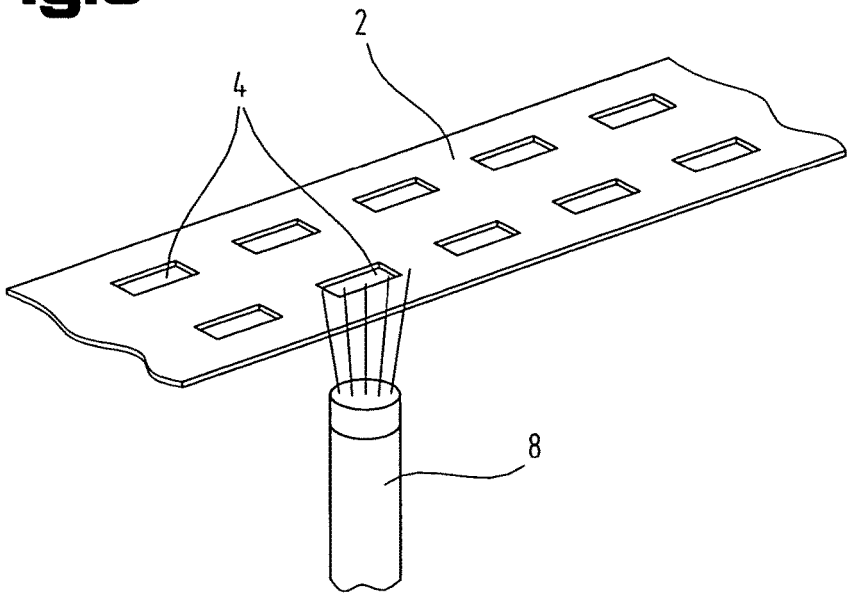
Figure 10:
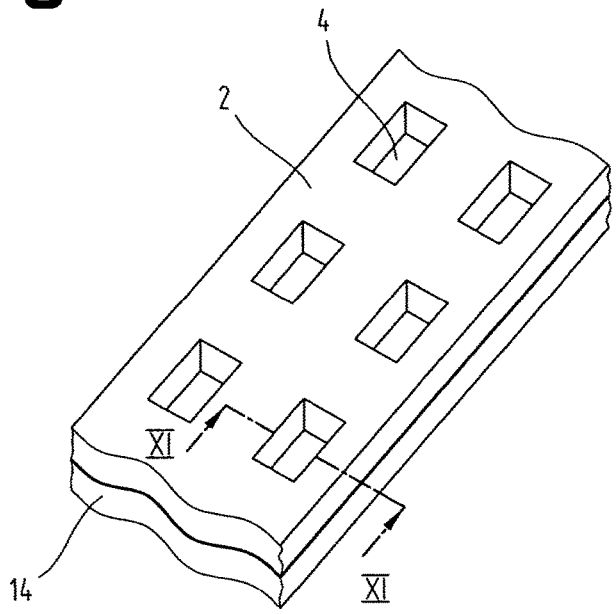
Figure 11:
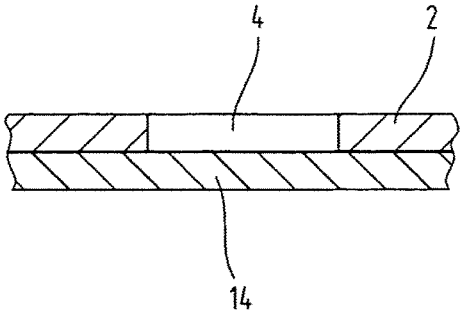
Figure 12:
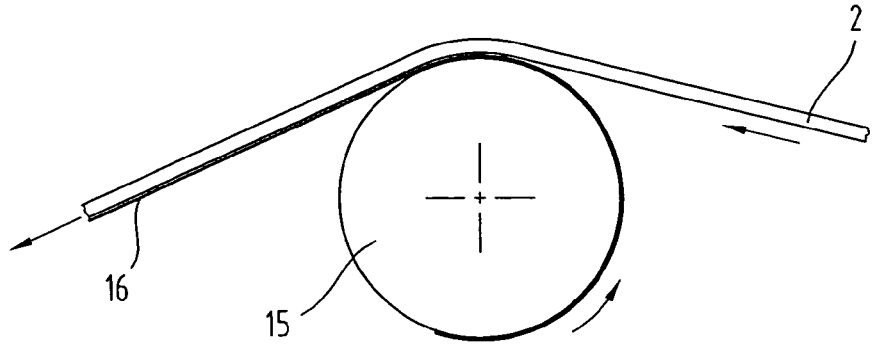
Figure 13:
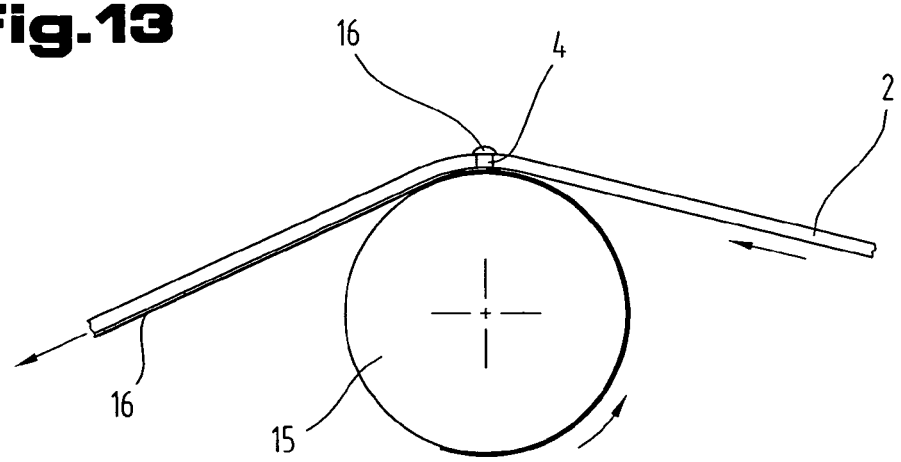
Figure 14:
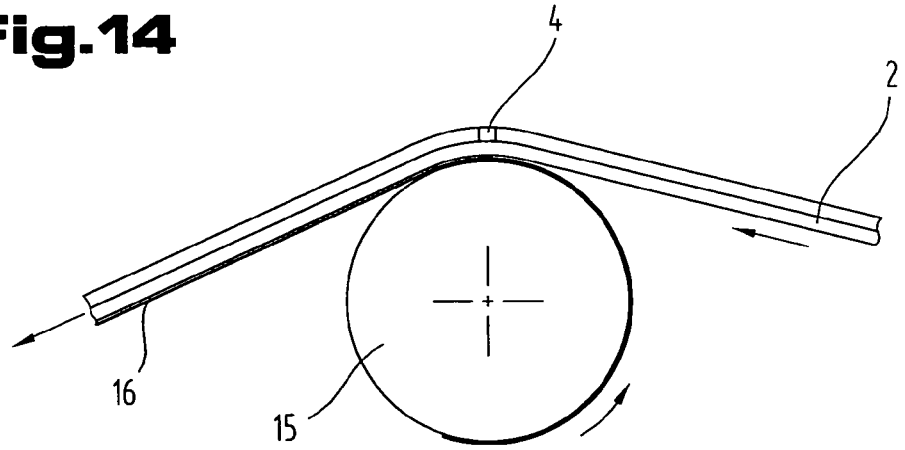
Figure 15:
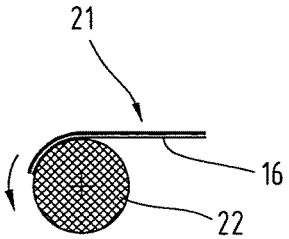
Figure 16:
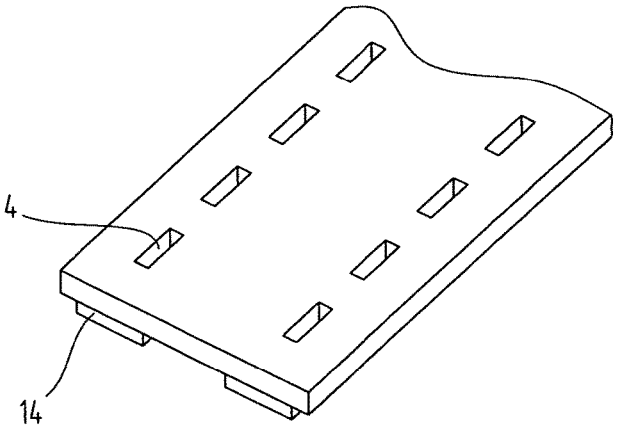
Figure 18:
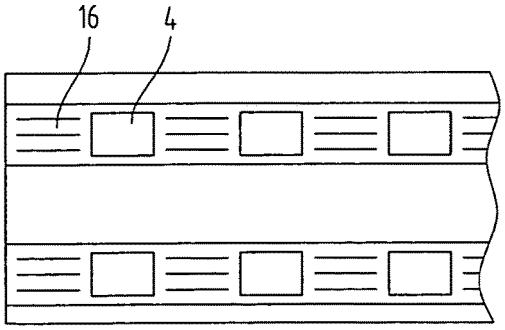
Figure 17:
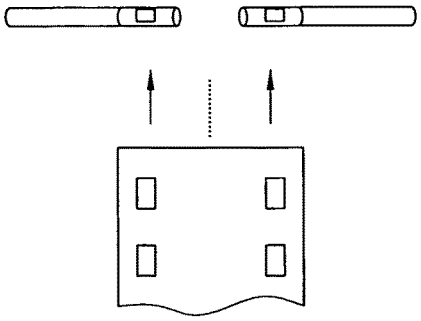

The invention and all of its additional advantages are explained in more detail by way of several non-restrictive exemplary embodiments which are represented in the drawings. The latter show in schematic view:

FIG. 1 a detailed view of a device according to the invention with a cross section of a mouthpiece cover paper to be produced;

FIG. 2 a plan view of a first variant of the mouthpiece cover paper of FIG. 1;

FIG. 3 a plan view of a second variant of the mouthpiece cover paper of FIG. 1;

FIG. 4 a plan view of a third variant of the mouthpiece cover paper of FIG. 1;

FIG. 5 a plan view of a fourth variant of the mouthpiece cover paper of FIG. 1;

FIG. 6 different variants of inspection holes of the mouthpiece cover paper of FIG. 1;

FIG. 7 further variants of inspection holes of the mouthpiece cover paper of FIG. 1;

FIG. 8 the mouthpiece cover paper of FIG. 1 with an optical sensor for detecting inspection holes;

FIG. 9 an exploded view of a detail of the design of a cigarette mouthpiece according to the invention;

FIG. 10 a further variant of a mouthpiece cover paper according to the invention with laminated foil;

FIG. 11 a cross section of the variant from FIG. 10 along the line XI-XI;

FIG. 12 a device for applying glue onto a mouthpiece cover paper;

FIG. 13 the device of FIG. 12 with a mouthpiece cover paper according to the invention according to FIG. 2;

FIG. 14 the device of FIG. 12 with a mouthpiece cover paper according to the invention according to FIGS. 11 and 12;

FIG. 15 a cross section of a filter strand with a mouthpiece cover to be adhered;

FIG. 16 a perspective view of a further variant of a mouthpiece cover paper according to the invention;

FIG. 17 a plan view of the mouthpiece cover paper of FIG. 16;

FIG. 18 a perspective view of a further variant of a mouthpiece cover paper according to the invention.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position. Furthermore, also individual features or combinations of features from the various exemplary embodiments shown and described can represent in themselves independent or inventive solutions.

According to FIG. 1 a device 1 according to the invention for producing a mouthpiece cover 2 and/or a filter wrap of a cigarette comprises at least one device 3 for cutting and/or stamping inspection holes 4 in a mouthpiece cover material and/or filter wrap material.

The device 3 for cutting and/or stamping can be for example a laser system or a mechanical stamping device.

The mouthpiece cover material and the filter wrap material are preferably paper. The mouthpiece cover 2 and filter wrap can however in principle also be produced from any other suitable material, for example from a plastic film or a laminate, for example an alumina laminated paper, cellophane, steamed materials, woven fabric etc.

According to the method of the invention for producing a mouthpiece cover 2 and/or a filter wrap of a cigarette the mouthpiece cover material and/or a filter wrap material are provided with at least one inspection hole 4 of predefinable shape. For this inspection holes 4 are cut or stamped in the mouthpiece cover material or the filter wrap material by means of the cutting or stamping device 3.

By means of the device 3 the mouthpiece cover material 2 and/or the filter wrap material can be provided with a predeterminable pattern consisting of a plurality of inspection holes 4. The mouthpiece cover material 2 according to the invention thus comprises one or more inspection holes 4, which allows or allow the view of an underlying layer with the naked eye. For example, the inspection holes 4 can have a diameter of between 0.1 mm and 25 mm, more preferably between 1 mm and 10 mm. This results in addition to the good detectability of the inspection holes 4 during the production of the cigarette mouthpiece in the good aeration of the cigarette mouthpiece.

Examples of different hole shapes and patterns of inspection holes 4 are shown in FIGS. 2 to 7. Thus the mouthpiece cover 2 of the invention according to FIGS. 2-4 can comprise a plurality of inspection holes 4 arranged in at least one row. Said row can in principle have any shape. Thus the row can be a linear row or can also be curved (FIG. 4). Also two or more rows can be arranged next to one another or parallel to one another on the mouthpiece cover 2 (FIG. 2).

As shown in FIG. 2, between two adjacent inspection holes 4 a logo 5 can also be applied onto the mouthpiece cover 2.

According to FIG. 3 a zone perforation 6 can also be arranged between two adjacent inspection holes 4.

FIG. 5 shows such an arrangement of inspection holes 4 and zone perforations 6 in more detail.

According to FIG. 6 the inspection holes 4 can have any contours. Thus the contours of the inspection holes 4 can be for example geometric outlines (circle, triangle, etc.), any stylized shapes (heart, flower etc.) or symbols can also be created.

As shown in FIG. 7, but also in FIG. 5, windows 7 of any shape can be formed from several spatially adjacent inspection holes 4. It should also be mentioned at this point that in all of the embodiments described the inspection windows 4 of one and the same mouthpiece cover 2 and/or one and the same filter wrap can have different sizes.

According to FIG. 8 the position of the inspection holes 4 can be determined precisely by means of an optical sensor 8, for example an infrared sensor. This is very significant mainly with regard to the production of the cigarette mouthpiece, as the exact cutting and alignment of the mouthpiece cover to the other components of the cigarette mouthpiece to be produced is made possible, such as for example the filter wrap.

As shown in FIG. 9 in a multipart design of a cigarette mouthpiece 9 at least one intermediate layer 11 can also be arranged between the mouthpiece cover 2 and the filter wrap 10.

Said intermediate layer 11 can be provided with at least one material with a predeterminable function, in particular to release an aroma and/or influence smoke values. Thus the intermediate layer 11 could be made for example of paper treated with effective substances, such as chemically reactive substances.

Furthermore, the intermediate layer 11 can also comprise at least one inspection hole 12, through which a view of the underlying layer, for example of the filter wrap 10 is made possible. The filter wrap 10 can also comprise inspection holes 13 through which the underlying, here not shown filter, can be seen. The inspection holes 12 of the intermediate layer 11 can in this case be smaller than the inspection holes 4 of the mouthpiece cover paper 2. If the filter wrap 10 comprises inspection holes 13, the latter can preferably also be smaller than the inspection holes 12 of the intermediate layer 11. In the present case "smaller" means smaller diameter or smaller area.

Of course, a design of the mouthpiece 9 is also possible in which no intermediate layer 11 is provided between the mouthpiece cover 2 and filter wrap 10.

Furthermore, designs of the cigarette mouthpiece 9 are also possible in which between the mouthpiece cover 2 and filter wrap 10 a plurality of intermediate layers 11 are arranged. To achieve special optical effects the different layers 2, 11, 10 can also be colored (differently). At this point it should also be noted that it is not absolutely necessary in all of the embodiments of the invention for the filter wrap 10 to also have an inspection hole 13, thus the filter wrap 10 could also be designed as a conventional filter wrap.

According to FIGS. 10 and 11 during the production, underneath the material of the mouthpiece cover 2 and/or material of the filter wrap provided with at least one inspection hole 4 a continuous layer 14 of transparent or semi-transparent material can be applied, for example made of plastic, paper, cellophane etc., which covers the inspection holes 4. More preferably, a cellophane layer is applied as the layer 14. The layer 14 can be adhered to the material of the mouthpiece cover 2, for example a mouthpiece cover paper and/or the filter wrap. The adhesion can be performed by using a hot-melt adhesive or by means of a cold adhesive or other suitable adhesion or bonding methods, such as stamping etc. The adhesion can also be performed for example by hot foil stamping methods.

As shown in FIG. 12 glue or adhesive can be applied onto the mouthpiece cover 2 by means of a glue roller 15. The glue 16 can be applied in this case to a lower side of the mouthpiece cover 2. The directions of movement of the mouthpiece cover 2 and the glue roller 15 are indicated by arrows in FIGS. 12 to 14.

It can be seen from FIG. 13 that during the application of glue 16, the latter can exit through the inspection holes 4. The glue 16 can be prevented from oozing through the inspection holes 4 according to FIG. 14 by applying the layer 14 onto the material web the mouthpiece cover 2. The glue 16 is applied according to the shown embodiment onto the plastic layer 14, which is preferably a cellophane layer.

After the application of adhesive or glue 16 the material web of the mouthpiece cover 2 or the filter wrap 10 can be separated by means of a cutting device in a device for producing a cigarette, a so-called cigarette maker. In a further processing stage the separated platelets of the mouthpiece cover 2 are adhered to filter strands.

FIG. 15 shows a cross section of a filter strand 17, onto which a separated platelet 18 of a mouthpiece cover 2 according to the invention is adhered.

According to FIGS. 16 and 17 the mouthpiece cover 2 and/or the filter wrap 10 comprising the inspection hole 4 can be rotated at least in part around the longitudinal axis of the cigarette mouthpiece 9 and/or in can be displaced in longitudinal direction of the cigarette mouthpiece 9. If only the filter wrap 10 is rotatable or displaceable, it is an advantage if at least two inspection holes 4 are provided in the mouthpiece cover 2, which are arranged to be diametrically opposite one another in relation to the cigarette mouthpiece 9. This enables the simple gripping and movement of the filter wrap 10.

As shown in FIG. 16, the layer 14 can also be arranged only in the area below the inspection holes 4 in order to prevent the passage of glue along a glue track.

As shown in FIG. 17 the mouthpiece cover material of the invention is adhered after its separation into platelets in the cigarette maker onto a filter strand. The filter strand is in this case arranged between the tobacco strands of a double cigarette. To separate the cigarettes the filter strand is divided by cutting and the double cigarette is separated into two individual cigarettes.

According to FIG. 18 the glue 16 can be applied in an area around and underneath the inspection holes 4. It is also possible however for the glue to be applied over the entire cylinder width of the mouthpiece cover material.

Lastly, it should be noted that the exemplary embodiments only show possible embodiment variants of the solution according to the invention, wherein the invention is not restricted to the specifically shown embodiment variants. In particular, also combinations of the individual embodiment variants are possible, whereby this variability owing to the teaching on technical procedure of the present invention lies within the ability of a person skilled in this technical field. The scope of protection also includes all conceivable embodiment variants, which realize the concept of the solution forming the basis of the invention and are not described or represented explicitly or are possible by combining individual details of the shown and described embodiment variants. Likewise the protection also extends to the individual components of the device according to the invention insofar as the latter in themselves are essential to the implementation of the invention.

LIST OF REFERENCE NUMERALS

1 Device for producing a mouthpiece cover and/or filter wrap
2 Mouthpiece cover
3 Device for cutting and/or stamping
4 Inspection hole
5 Logo
6 Zone perforation
7 Window formed by a plurality of inspection holes
8 Sensor
9 Cigarette mouthpiece
10 Filter wrap
11 Intermediate layer
12 Inspection holes of the intermediate layer
13 Inspection holes of the filter wrap
14 Plastic layer
15 Glue roller
16 Glue
17 Filter strand
18 Platelet
19 Winning code
20 Area
21 Predetermined breaking points
22 Material
23 Cigarette mouthpiece
24 Mouthpiece cover
25 Filter wrap
26 Chamber
27 Filler
28 Tobacco strand
29 Cigarette mouthpiece
30 Strip
31 Strip
32 Transparent or semi-transparent material
33 Filter strand

The invention claimed is:

1. A method for producing a cigarette mouthpiece, the method comprising steps of:

providing a mouthpiece cover material and/or a filter wrap material having a plurality of holes of predeterminable shape arranged in at least one row, the mouthpiece cover material and/or the filter wrap material comprising a cover-paper comprising the plurality of inspection holes and a continuous plastic layer laminated to the cover-paper and completely covering the plurality of inspection holes and a backside of the cover-paper;

applying adhesive onto a surface of the continuous plastic layer via a glue roller, the surface facing away from the plurality of inspection holes and the cover-paper, the continuous plastic layer preventing oozing of the adhesive through the plurality of inspection holes and preventing the adhesive from contacting the cover-paper, separating a platelet comprising an inspection hole from the mouthpiece cover material and/or the filter wrap material after the applying of the adhesive onto the continuous plastic layer; and applying the platelet to a filter strand by adhering the continuous plastic layer to the filter strand via the adhesive on the continuous plastic layer;

wherein the continuous plastic layer is arranged underneath the cover-paper.

2. The method as claimed in claim 1, wherein the plastic layer is transparent or semi-transparent.

3. The method as claimed in claim 2, wherein the continuous plastic layer comprises cellophane.

4. The method as claimed in claim 1, wherein the continuous plastic layer comprises cellophane.

5. The method as claimed in claim 1, wherein the at least one row is a linear row.

6. The method as claimed in claim 5, wherein the at least one row of the plurality of inspection holes comprises at least two mutually parallel rows.

7. The method as claimed in claim 1, wherein at least one window is formed from a plurality of spatially adjacent inspection holes of the plurality of inspection holes.

8. The method as claimed in claim 1, wherein the plurality of inspection holes comprises at least two inspection holes of different size.

9. The method as claimed in claim 1, wherein the plurality of inspection holes are produced by stamping and/or cutting sections of the cover-paper.

10. The method as claimed in claim 1, wherein a laser is used to produce the plurality of inspection holes.

11. The method as claimed in claim 1, wherein a mechanical stamping device is used for the production of the plurality of inspection holes.

12. The method as claimed in claim 1, wherein at least one intermediate layer is arranged between the cover-paper and the continuous plastic layer.

13. The method as claimed in claim 12, wherein the at least one intermediate layer comprises at least one inspection opening.

14. The method as claimed in claim 13, wherein the at least one inspection hole of the at least one intermediate layer is smaller than an inspection hole of the plurality of inspection holes of the cover-paper.

* * * * *